US006447389B1

(12) United States Patent
Kuo

(10) Patent No.: US 6,447,389 B1
(45) Date of Patent: Sep. 10, 2002

(54) WIND-HOLE BASE OF A BLOWER FOR AN AIR CONDITIONER

(76) Inventor: Chin-Sheng Kuo, P.O. Box 90, Tainan City (TW)

( * ) Notice: Subject to any disclaimer, the term of this patent is extended or adjusted under 35 U.S.C. 154(b) by 0 days.

(21) Appl. No.: 09/850,083

(22) Filed: May 8, 2001

(51) Int. Cl.[7] ..... F24F 13/075
(52) U.S. Cl. ..... 454/248; 454/285
(58) Field of Search ..... 454/245, 246, 454/247, 248, 230, 233, 285, 296, 297; 55/385.2, 494, 502, 505, 506

(56) References Cited

U.S. PATENT DOCUMENTS 688,132 A * 12/1901 Sims ..... 126/99 P
1,152,864 A * 9/1915 Triggs ..... 126/99 R
1,177,779 A * 4/1916 Kerch ..... 126/99 R
3,065,686 A * 11/1962 Geocaris ..... 362/218
3,301,163 A * 1/1967 Raider ..... 454/248
3,570,220 A * 3/1971 Felter
4,217,121 A * 8/1980 Fichter ..... 454/296
4,628,801 A * 12/1986 Hashimoto ..... 454/285
4,801,316 A * 1/1989 Schroeder ..... 55/385.1
5,076,152 A * 12/1991 Muller et al. ..... 454/245
5,577,958 A * 11/1996 Kumekawa et al. ..... 454/233
6,264,551 B1 * 7/2001 Smith ..... 454/245

* cited by examiner

*Primary Examiner*—Harold Joyce

(57) ABSTRACT

A wind-hole base of a blower for an air conditioner includes a faceplate, an inlet cover plate, two outlet bases, and two outlet case plates and two fix plates. The faceplate has two outlets and an inlet, a filter net is provided in the inlet, and a connector is each provided at two sides of the inlet. The inlet cover plate closes on the inlet. The outlet case plates are deposited on the outlet bases, which are respectively combined on the outlets. The fix plates are mounted on a steel frame fixed on a ceiling, screwed with the connector of the faceplate. The wind outlet cases are fixed on the two outlets and have a wind hole connected with a windpipe. Thus the wind-hole base has two functions of sending wind out and sucking wind in.

8 Claims, 6 Drawing Sheets

WIND-HOLE BASE OF A BLOWER FOR AN AIR CONDITIONER

BACKGROUND OF THE INVENTION

1. Filed of the Invention

This invention relates to a wind-hole base of a blower for an air conditioner, particularly to one possible to be combined quickly with a ceiling, having a faceplate provided with two outlets and an inlet, and a filter net provided in the inlet and able to be swing so as to facilitate check and repair of the wind-hole base when necessary.

2. Description of the Prior Art

A conventional wind-hole base (A) for a central air conditioner shown in FIGS. 1 and 2, uses windpipes A1 connected to a main machine to circulate cool air and retrieve hot wind back. And an outlet A2 is provided at an end exit of each windpipe A1 and a wind drawing hole A3 is provided near the outlet A2, performing air circulation to every room at the same time. Each room may have a steel frame 9 fixed on the ceiling for mounting a plurality of the outlets A2 and the wind drawing holes A3 thereon. So the more the outlets A2 and the wind drawing holes A3 are provided, the more the windpipes A1 and the wind hole bases (A) have to be provided, complicating constructing processes and subsequent difficulty involved in maintenance and repair after they are finished.

SUMMARY OF THE INVENTION

The objective of the invention is to offer a wind-hole base functioning as an outlet and an inlet at the same time, capable to reduce the number of the wind-hole bases of a blower for an air conditioner, speeding the fixing process, saving material and facilitating assembly, disassembly, maintenance and repair as well.

A first feature of the invention is a faceplate provided with two outlets and one inlet, a filter net provided in the inlet, two wind outlet cases fixed respectively on the two outlet of the faceplate and having an outlet hole facing the outlet of the faceplate, and a connector fixed around the outlet hole to connect with a windpipe.

A second feature of the invention is an inlet cover plate positioned stably in an inner upper surface of the inlet.

A third feature of the invention is two fix plates fixed across on a steel frame mounted on the ceiling, screwed with connectors of the faceplate and having an elongate slot respectively in two end portions for the threaded rod to pass through to adjust the position of the faceplate and the gap between the faceplate and the steel frame.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
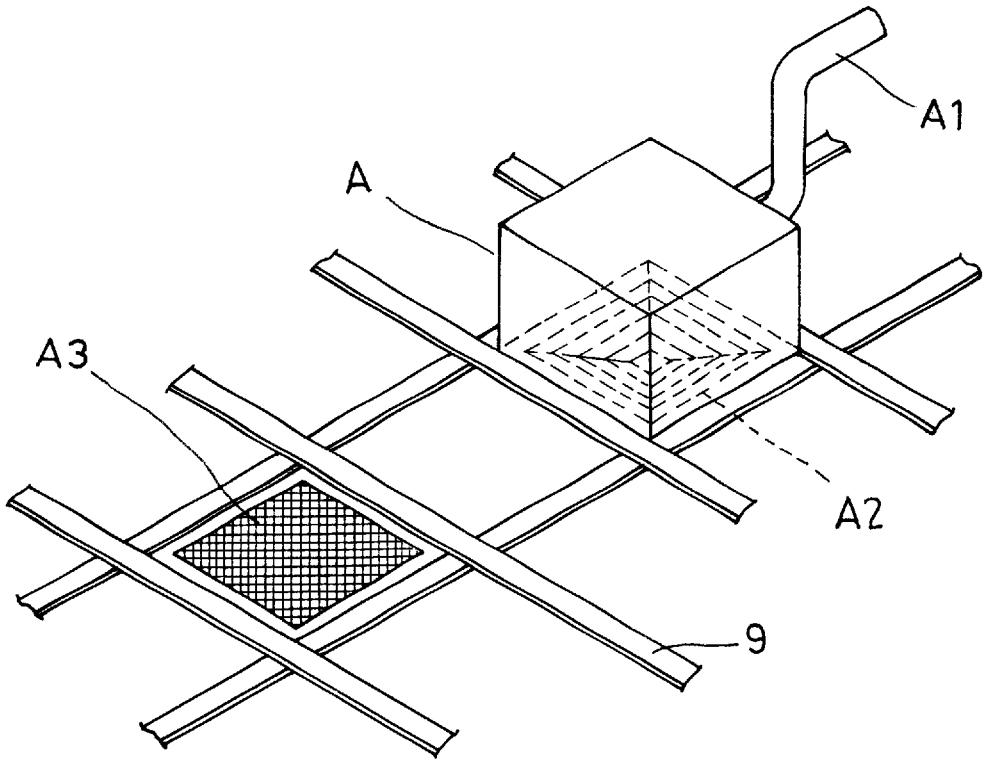
FIG. 1 (PRIOR ART)
FIG. 1 is a perspective view of a conventional wind-hole base with an outlet and an inlet for a central air conditioner.
Figure 2:
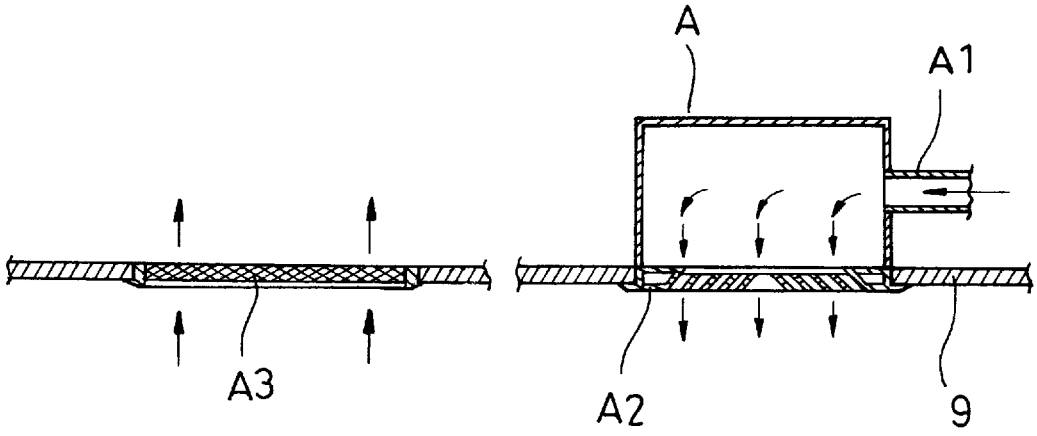
FIG. 2 (PRIOR ART)
FIG. 2 is a side view of the conventional wind-hole base with an outlet and an inlet fixed on a steel frame.

A preferred embodiment of a wind-hole base of a blower for an air conditioner in the present invention, as shown in FIGS. 3, 4, 5, and 6, includes a faceplate 1, an inlet cover plate 2, two wind outlet bases 3, two outlet case covers 4 and two fix plates 5 as main components combined together.

The faceplate 1 has two outlets 10 provided respectively in two lengthwise opposite sides bored with plural combine holes 100, wind guiding leaves 101 and cool air adjusting plates 102 adjustably fitted inside each outlet 10 and free to turn their directions by a motor 15 fixed on one side of the outlet 10 (shown in FIGS. 3 and 4), an inlet 11 formed in an intermediate portion, a circumferential edge 110 on an upper side of the inlet 11 and plural combine holes 111 formed in the circumferential edge 110, and plural engage grooves 112 on one side of a side wall of the inlet 11, plural engage holes 113 formed in the other side of the side wall of the inlet 11. A grid plate 12 and a filter net. 13 are provided in the inlet 11, and the grid plate 12 has an inner recess 120 formed in a rear side, two engage blocks 121 on one lengthwise side and resilient members 122 fixed on the other lengthwise side to face the engage holes 113. The grid plate 12 further has an insert hole 123 respectively formed in two other sidewalls. The grid plate 12 further has a slanting stop corner 124 in the inner recess 120. The filter net 13 has an elongate projection 131 formed respectively on two lateral sides to insert in the insert holes 123 of the grid plate 12. Further, a connector 14 is screwed respectively at two sides of the inlet 11 of the faceplate 1 with screws 7, having a threaded rod 140 extending upward.

The inlet cover plate 2 closes on the circumferential edge 110 of the inlet hole 11 of the faceplate 1, having plural screw holes 20 to face the combine holes 111 of the inlet 11 of the faceplate 1 and screwed together with screws 7, two inlet holes 21 and a cylindrical connector 22 fixed around each inlet hole 21 to connect to a windpipe 6, and having a PU windpipe gasket 220 fixed on an outer end to quickly combine with a wind pipe 6 and tightly fit around the connector 22. Further, the inlet cover plate 2 has a reinforcing rib 23 fixed lateral on the center of the bottom surface.

The two outlet bases 3 are combined respectively on the two outlets 11 of the faceplate 1, having a hollow interior of a wide upper portion and a narrow lower portion to face each outlet 10, having two end strips 30 fixed on two lateral sides and provided with two holes 300 so that each outlet base 3 may sit and be combined on the outlet 10 with screws 7 engaging the combine holes 100 and 300. The outlet base 3 further has a lengthwise wing strip 31 with plural screw holes 310 formed respectively on two lengthwise sides.

The two outlet case covers 4 are fixed on the two outlet bases 3, respectively having an outlet hole 40, a windpipe connector 41 fixed around the outlet hole 40, a PU elastic windpipe gasket 410 fixed around an upper circumferential edge of the connector 41, a cover plate 42 fixed on the bottom of each outlet case cover 4 to face each wing strip 31 of each outlet base 3 and having plural screw holes 420 facing the screw holes 310 of each wing strip 31 to be screwed together.

Figure 3:
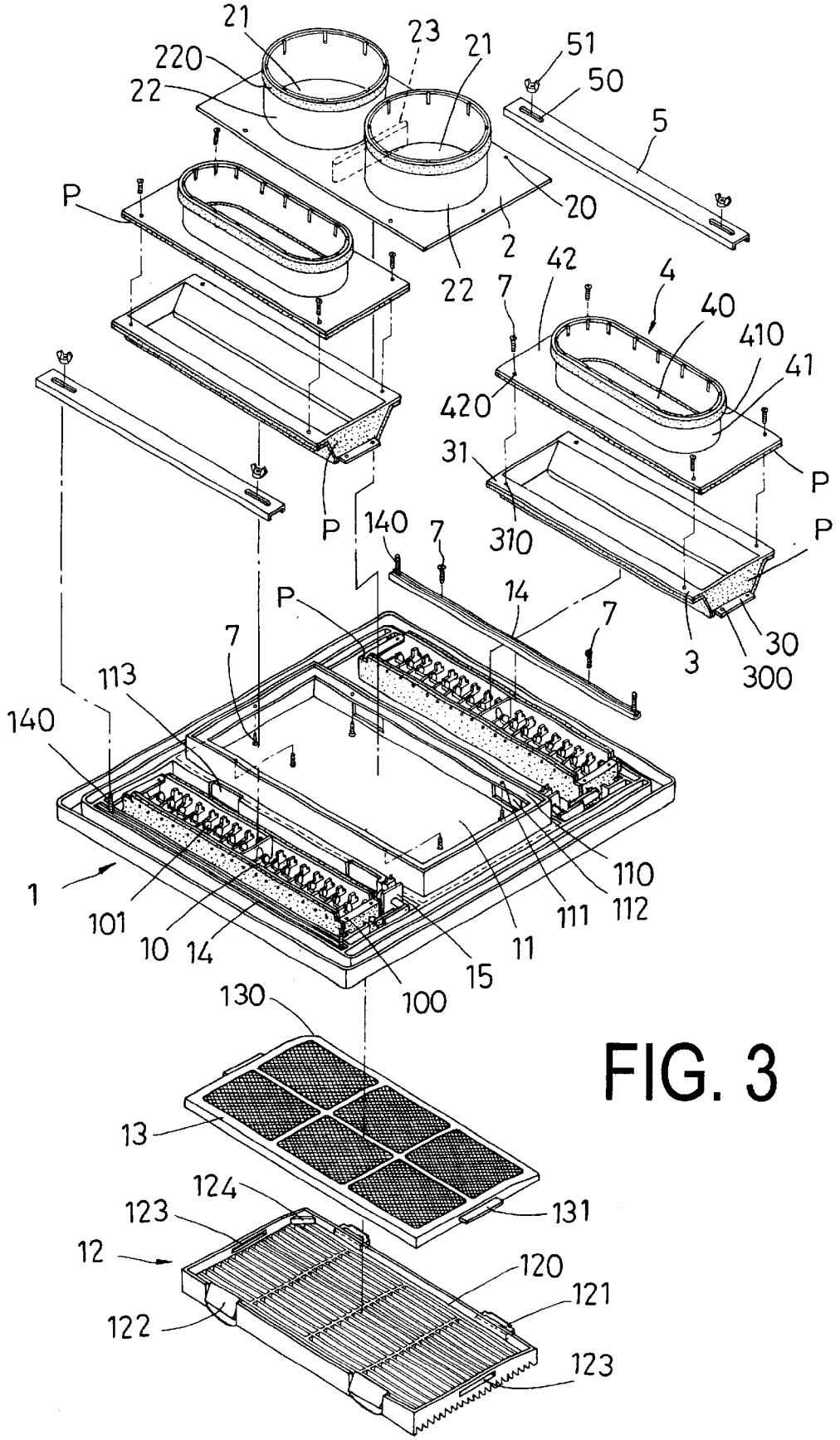
FIG. 3 is an exploded perspective view of a wind-hole base of a blower for an air conditioner in the present invention.
Figure 4:
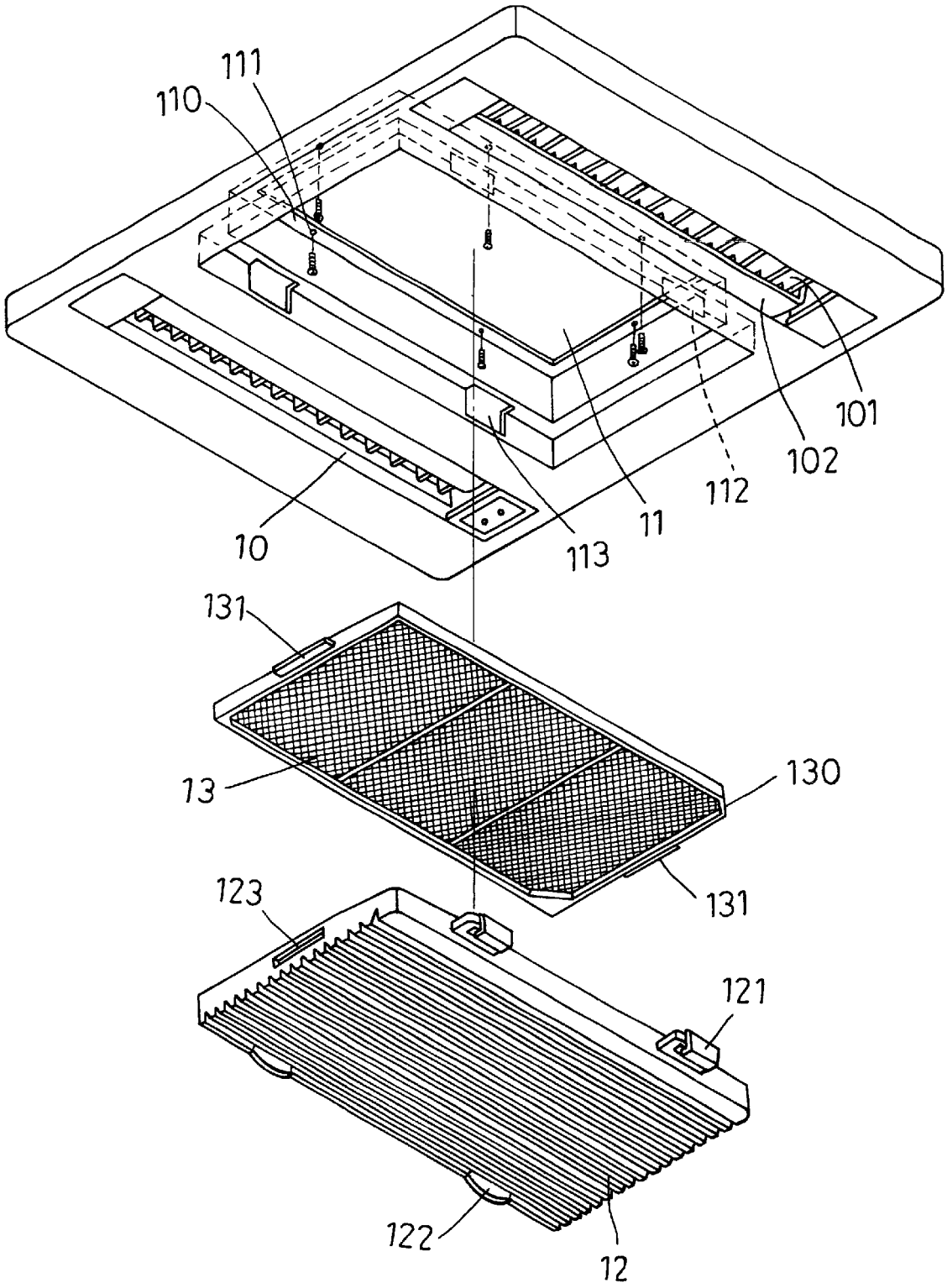
FIG. 4 is a perspective view of a faceplate and a grid plate in the present invention.
Figure 5:
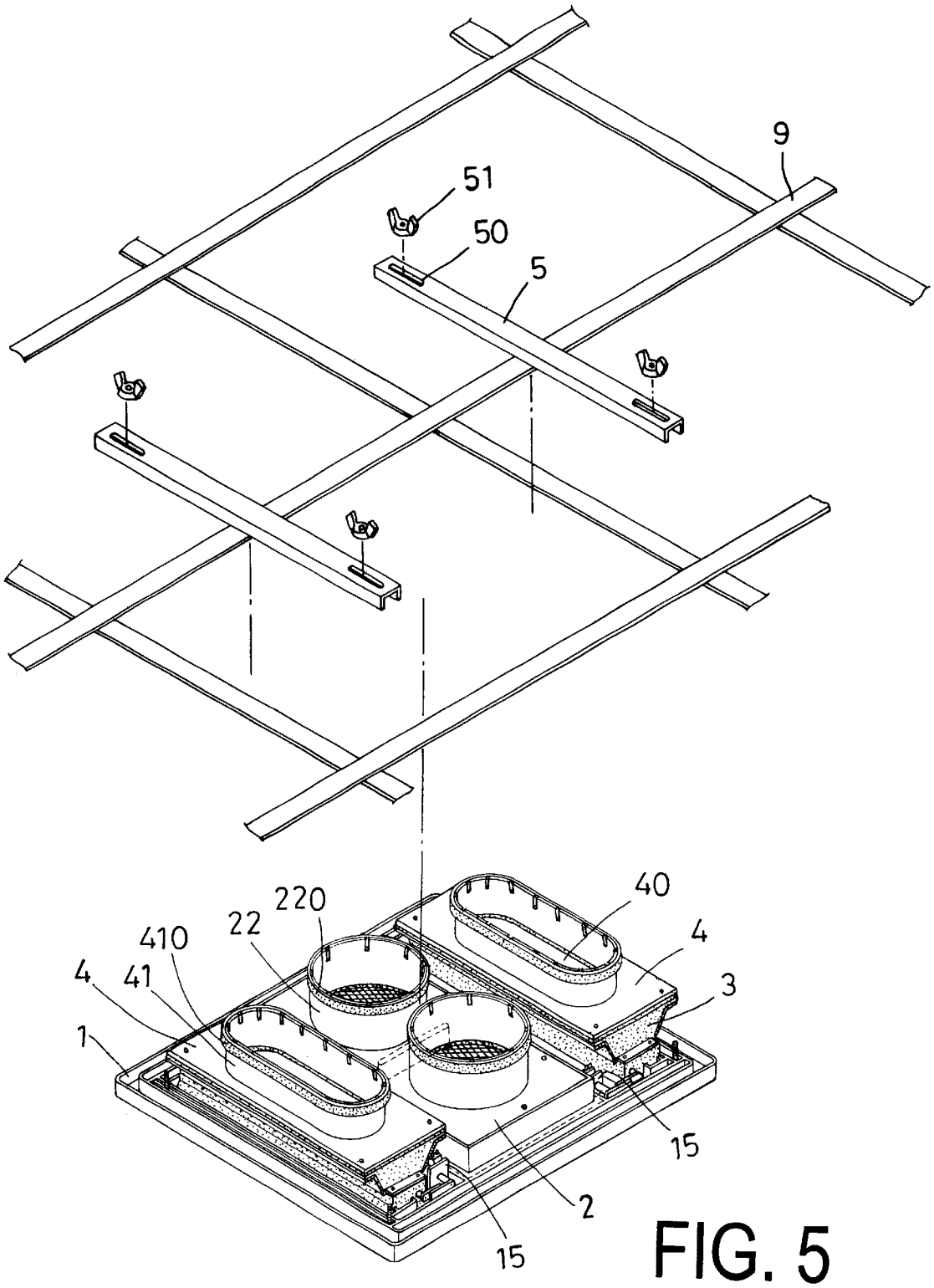
FIG. 5 is a side cross-sectional view of the wind-hole base to be mounted on a ceiling in the present invention.

The two elongate fix plates 5 are fixed across on the steel frame 9 mounted on the ceiling as shown in FIGS. 3 and 5, combined with the connectors 14 of the faceplate 1, having an elongate slot 50 respectively in two end portions for the threaded rod 140 to pass through to adjust their own position and fixed with screws 51 in place, and in addition, the screws 51 can adjust the gap between the faceplate 1 and the steel frame 6 as well.

The components to be combined with the wind blowing system for sending out cool air, such as the faceplate 1 with the two outlets 10, the two outlet bases 3 and the two outlet case covers 4, have temperature preserving material P of PU on their surfaces to prevent frost from forming if cool air comes across heat. Further, the inlet hole 21 of the inlet cover plate 2 has a sealing material sealing the hole (not shown in Figures), which may be removed off if necessary. If only one of the inlet holes 21 is needed to connect to a windpipe 6, then the sealing material of that inlet hole 21 is removed, with the other inlet holes 21 kept sealed. Then wind can return along the single windpipe 6.

Figure 6:
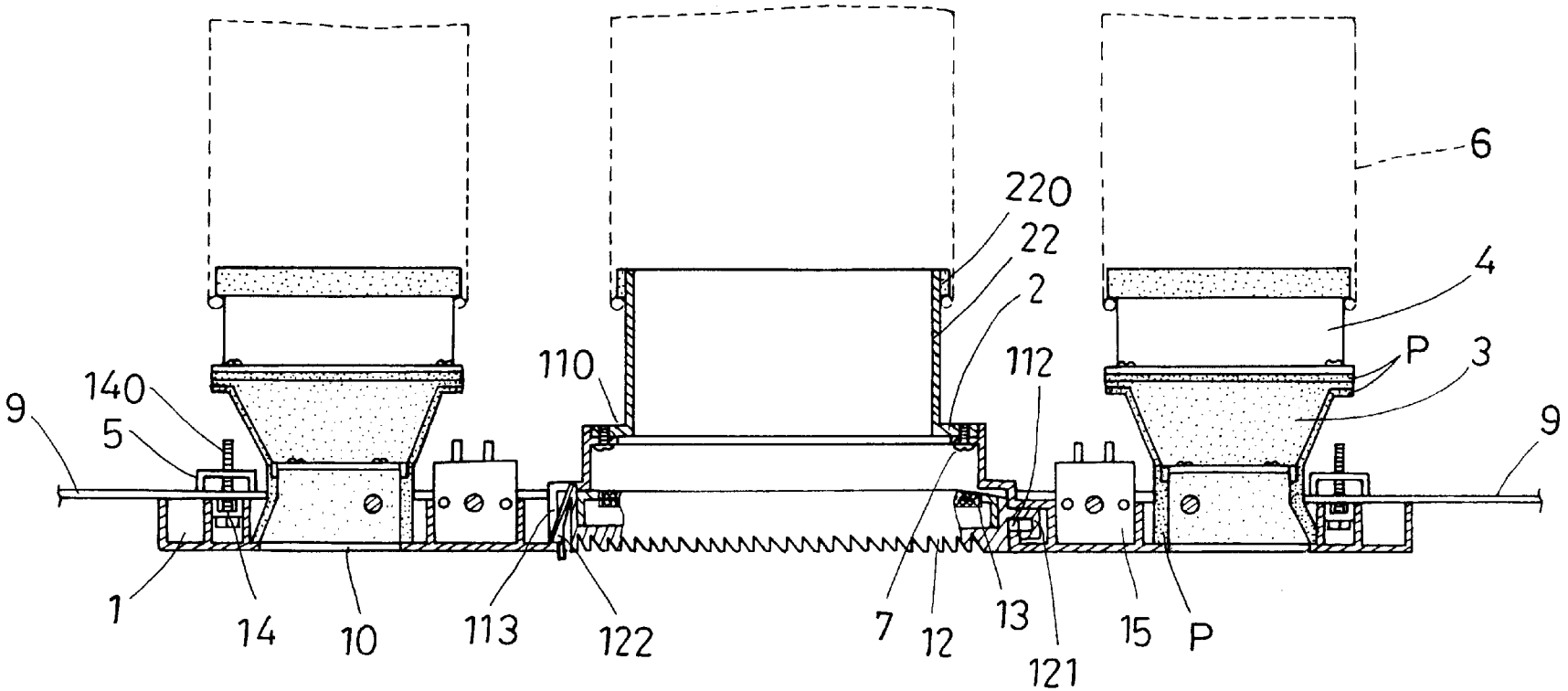
FIG. 6 is a side cross-sectional view of the wind-hole base in the present invention; and, FIG. 7 is a cross-sectional view of the wind-hole base in using condition in the present invention.

In assembling, referring to FIGS. 3–6, firstly fix the cover plate 2 on the circumferential edge 110 of the inlet 11 of the faceplate 1, with the screw holes 20 facing the combined holes 110 and screwed together with screws 7 from under to fix the inlet cover plate 2 with the faceplate 1. Next, the slanting corner 130 of the filter net 13 is placed to face a slanting corner 124 of the grid plate 12, with the projecting strips 130 fitting in the insert holes 123 of the grid plate 12, thus the filter net 13 can be quickly and firmly combined with the grid plate 12. Then the engage blocks 121 of the grid plate 12 engage the engage grooves 112 to stabilize the grid plate 12. Then one side of each of the resilient members 122 of the grid plate 12 is moved to the engage hole 113 of the inlet 1, stabilizing the grid plate 12 in the inlet 11. Then the two outlet bases 3 are combined on the two outlets respectively, with the two end plates 30 and the combine holes 300 just facing and screwed with the combine holes 100 of each outlet with screws 7. Further each outlet case cover 4 is placed on the outlet bases 3, with the cover plates 42 contacting and screwed together with the wing plates 31 respectively, forming the wind-hole base. When the wind-hole base is to be combined with the ceiling, firstly the fix plates 5 are fixed across the steel frame 9, as shown in FIG. 5. Further, the faceplate 1 is stabilized with the fix plates 5, with the threaded rods 140 of the connector 14 passing through the holes 50 of the fix plates 5 and screwed tightly together with screws 51. In addition, the windpipe connectors 41 of the outlet cover plate 4 and the connector base 22 of the inlet cover plate 2 are connected to the windpipes 6, finishing assembly of the wind-hole base sending wind out and retrieving wind back, as shown in FIG. 6.

Figure 7:
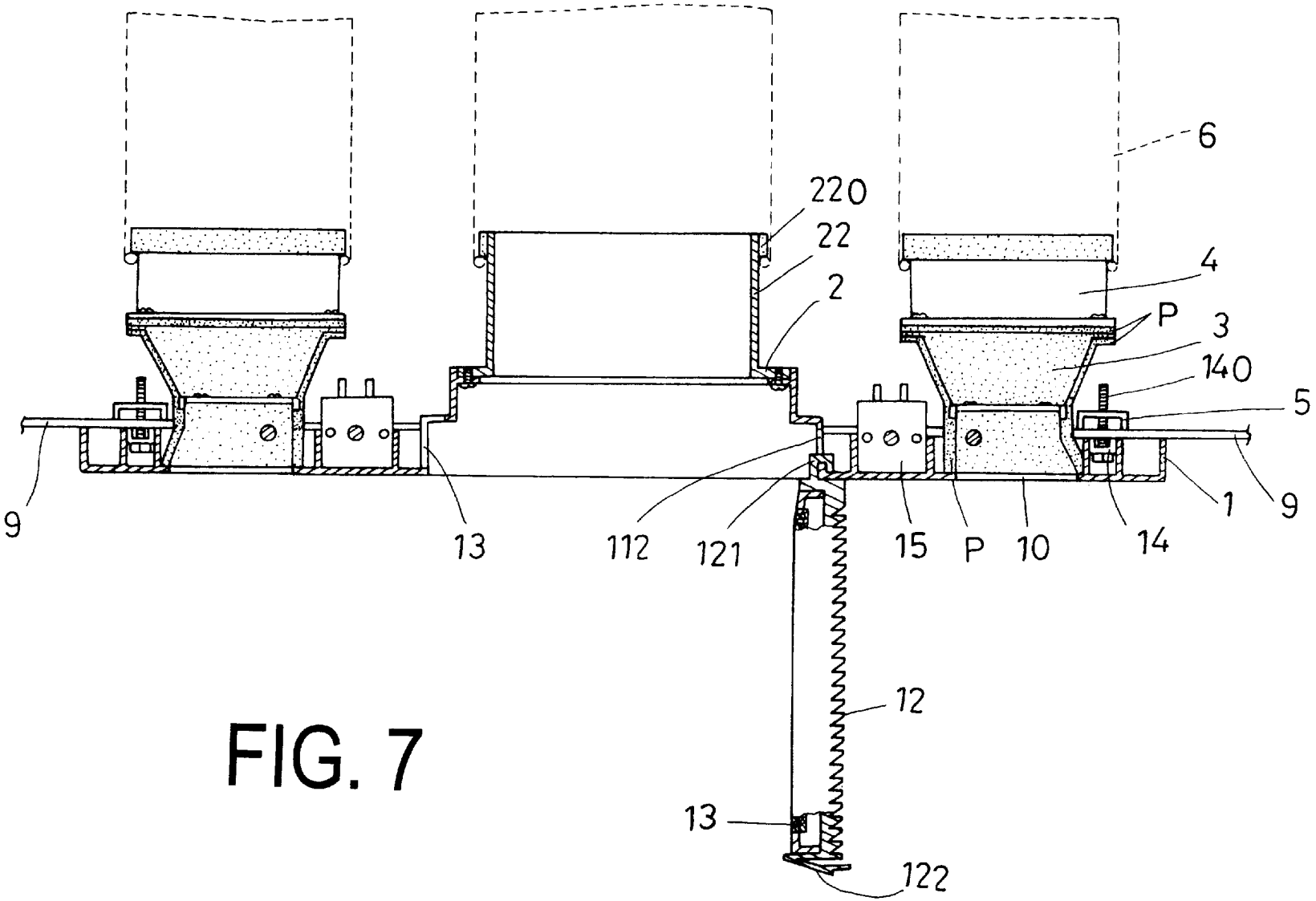

Provided the wind-hole base or the wind pipes have to be checked or repaired, first remove the grid plate 12 together with the filter net 13 (referring to FIGS. 3, 6 and 7), and push the resilient members 122 to let them separate from the engage holes 113, permitting the grid plate 12 swing down, as shown in FIG. 7. As the other side of the grid plate 12 has the engage blocks 121 engaging the engage grooves 112 of the inlet 11, the grid plate 12 may swing down with the upper side hooking the inlet 11. Then the screws 7 of the inlet cover plate 2 can be loosened and pushed open. Now a worker can go through the inlet 11 in the wind-hole base for check or repair. Or a worker can adjust the location of the connectors 14 of the faceplate 1. Thus, maintenance or repair can be carried out easily.

The invention has the following advantages as can be understood from the aforesaid description.

1. Its assembly can be performed quickly and easily

2. It has a structure of both wind sending-out and sucking-in.

3. Its maintenance or repair may be carried out with convenience.

4. The faceplate can be adjusted vertically in the gap against the ceiling (or the steel frame) and also moved laterally by means of the connector and the fix frame with screws to alter its location if necessary.

5. The filter net can be pulled out from the recess of the grid plate for washing or replacing, very quickly and convenient.

6. The wind hole base does not need to be taken off, convenient for check and repair, having the effect of repair and wind returning.

7. The inlet cover plate and the inlet and the outlet base and the outlet case cover are separately formed and screwed with windpipe connectors of different sizes so as to connected with windpipes of different sizes, very convenient.

While the preferred embodiment of the invention has been described above, it will be recognized and understood that various modifications may be made therein and the appended claims are intended to cover all such modifications that may fall within the spirit and scope of the invention.

What is claimed is:

1. The wind-hole base of a blower for an air conditioner comprising:

a faceplate having two outlets and at least one inlet, said at least one inlet having a filter net, at least two or more connectors fixed respectively at two sides of said at least one inlet, each said connector having a threaded rod extending upward at two ends;

at least one inlet cover plate closing on said inlet, having at least one inlet hole, and a windpipe connector fixed around said inlet hole to connect to a windpipe;

two outlet case covers combined on said two outlets of said faceplate, having respectively an outlet hole windpipe connector fixed around each said outlet hole for connecting to a windpipe;

two elongate fix plates mounted across a steel frame fixed on a ceiling, screwed with said connectors of said faceplate, having respectively two elongate slots in two sides for said threaded rods to pass through upward so that said faceplate may be moved laterally and adjusted a gap between itself and said steel frame; and, said components described above forming said wind-hole base with said inlet and said outlets quickly, said faceplate screwed with said steel frame by means of said fix plates to assemble said wind-hole base and convenient for adjusting and moving its location, said filter net taken off for a worker to enter said wind-hole base for check and repair conveniently and practically;

wherein said inlet of said faceplate has a circumferential edge for placing said inlet cover plate, plural combine holes formed in said circumferential edge, said inlet cover plate having plural combine holes to face said combine holes of said circumferential edge for screws to screw through to combine said faceplate with said inlet cover plate.

2. The wind-hole base of a blower for an air conditioner as claimed as claim 1, wherein an outlet base is added respectively between each said outlet and each said outlet case cover, each said outlet base has a side plate combined with a bottom of each said outlet base to be placed and screwed with each said outlet, and two wing strips with holes are fixed on an upper portion of two lengthwise sides of each said outlet base for each said outlet case cover placed and screwed thereon, each said outlet base possible to combine with said outlet case covers with said windpipe connectors of different sizes.

3. The wind hole base of a blower for an air conditioner as claimed in claim 1, wherein said outlet of said faceplate has plural guiding leaves and cool air adjusting plates in said outlet, and a driving motor fixed at one side of said inlet to turn them automatically.

4. The wind-hole base of a blower for an air conditioner as claimed in claim 1, wherein said connectors of said wind outlet case covers and said inlet cover plate have plural flexible gaskets fitted around an outer side end edge to fit with a windpipe conveniently.

5. The wind-hole base of a blower for an air conditioner as claimed in claim 1, wherein said inlet of said faceplate has an engage groove formed in an inner wall and an engage hole formed in an opposite inner wall, a grid plate with said filter net provided in said inlet, an engage block on a side to face said engage groove of said inlet, plural resilient member on the other side to face said engage holes, said grid plate possible to swing down in said faceplate so as to quicken assembly and disassembly.

6. The wind-hole base of a blower for an air conditioner as claimed in claim 1, wherein said grid plate has a recess facing said faceplate, plural insert holes formed in two side walls of said recess, said filter net having a projecting strip formed on two lateral sides to insert in said insert holes to combine said filter net with said grid plate, said grid plate having a slanting corner to fit with said slanting corner of said filter net.

7. The wind-hole base of a blower for an air conditioner as claimed in claim 1, wherein said outlets of said faceplate and said outlet case cover have temperature preserving material fixed on their contact surfaces and wall surfaces to preserve heat, preventing frost from forming.

8. The wind-hole base of a blower for an air conditioner as claimed in claim 2, wherein said outlet base has its wall attached with temperature preserving material.

* * * * *